US005283009A

United States Patent [19]

Speckman et al.

[11] Patent Number: 5,283,009

[45] Date of Patent: Feb. 1, 1994

[54] PROCESS FOR PREPARING POLYHYDROXY FATTY ACID AMIDE COMPOSITIONS

[75] Inventors: D. Thomas Speckman; Lawrence C. Grahl; Kofi Ofosu-Asante, all of Cincinnati, Ohio

[73] Assignee: The Procter & Gamble Co., Cincinnati, Ohio

[21] Appl. No.: 848,883

[22] Filed: Mar. 10, 1992

[51] Int. Cl.[5] ..... C11D 3/04; C11D 3/32; C11D 17/08

[52] U.S. Cl. ..... 252/548; 252/529; 252/153; 252/173; 252/135; 252/174.19

[58] Field of Search ..... 252/548, 529, 153, 173, 252/135, 174.19

[56] References Cited

U.S. PATENT DOCUMENTS

| | | | |
|---|---|---|---|
| 2,703,798 | 3/1955 | Schwartz | 260/211 |
| 3,644,204 | 2/1972 | Heins et al. | 252/8.6 |
| 3,764,531 | 10/1973 | Eckert et al. | 252/8.6 |
| 4,107,095 | 8/1978 | Klisch et al. | 252/541 |
| 4,118,404 | 10/1978 | Nelson | 252/548 |
| 5,009,814 | 4/1991 | Kelkenberg et al. | 252/174.21 |
| 5,057,246 | 10/1991 | Bertho et al. | 252/173 |

*Primary Examiner*—Paul Lieberman
*Assistant Examiner*—Erin Higgins
*Attorney, Agent, or Firm*—Mary P. McMahon; Kathleen M. Harleston

[57] ABSTRACT

A process for preparing polyhydroxy fatty acid amide compositions which are pumpable at temperatures between about 70° F. (21.1° C.) and about 120° F. (48.9° C.) by adding certain soluble inorganic salts or salts of $C_{1-3}$ carboxylic acids to a heated polyhydroxy fatty acid amide preparation.

11 Claims, No Drawings

PROCESS FOR PREPARING POLYHYDROXY FATTY ACID AMIDE COMPOSITIONS

TECHNICAL FIELD

The present invention relates to a process for preparing a pumpable polyhydroxy fatty acid amide composition. The invention also relates to a composition containing from about 90% to about 100% polyhydroxy fatty acid amide mixture and from about 0.01% to about 10% of inorganic salt or salt of a $C_{1-3}$ carboxylic acid having certain metal ions. Detergent compositions are preferred.

BACKGROUND OF THE INVENTION

Polyhydroxy fatty acid amide surfactant is a desirable component of detergent compositions for its cleaning and mildness characteristics, but it can be difficult to handle in the plant and to formulate into a composition because of its high melting point. The melting point of a 50% N-cocacyl N-methyl glucamide mixture, for example, is about 142° F. (61.1° C.). It is difficult to pump concentrated polyhydroxy fatty acid amide unless it is diluted or heated to a temperature at or above its melting point. Polyhydroxy fatty acid amide is also often difficult to formulate into detergent compositions. For example, it may resolidify upon introduction to the cooler liquid ingredients. To get this component into solution often requires a great deal of stirring, heating above the melting point, diluting and/or use of solvents.

It has been found that a pumpable polyhydroxy fatty acid amide composition can be formed by mixing certain soluble inorganic salts or $C_{1-3}$ carboxylate salts into heated polyhydroxy fatty acid amide surfactant. Surprisingly, sodium and ammonium salts do not yield this benefit. The polyhydroxy fatty acid amide composition is thus easier to handle in the plant and to formulate into detergent compositions, particularly liquid detergent compositions.

The use of N-alkyl glucamides in detergent compositions has been discussed. U.S. Pat. No. 2,965,576, issued Dec. 20, 1960 to E. R. Wilson, and G.B. Patent 809,060, published Feb. 18, 1959, relate to detergent compositions containing anionic surfactants and certain amide surfactants, which can include N-methyl glucamide, added as a low temperature suds enhancing agent.

U.S. Pat. No. 2,703,798, issued Mar. 8, 1955 to A. M. Schwartz, relates to aqueous detergent compositions containing the condensation reaction product of N-alkyl glucamine and an aliphatic ester of a fatty acid. It is also known to prepare a sulfuric ester of acylated glucamine as disclosed in U.S. Pat. No. 2,717,894, issued Sep. 13, 1955, to A. M. Schwartz.

European Patent 0 285 768, published Oct. 12, 1988 to H. Kelkenberg et al relates to the use of N-polyhydroxy alkyl fatty acid amides as thickening agents in aqueous detergent systems. Included are amides of the formula $R_1C(O)N(X)R_2$ wherein $R_1$ is a $C_1$–$C_{17}$ (preferably $C_7$–$C_{17}$) alkyl, $R_2$ is hydrogen, a $C_1$–$C_{18}$ (preferably $C_1$–$C_6$) alkyl, or an alkylene oxide, and X is a polyhydroxy alkyl having four to seven carbon atoms, e.g., N-methyl, coconut fatty acid glucamide.

SUMMARY OF THE INVENTION

The present invention encompasses a process for preparing a pumpable polyhydroxy fatty acid amide composition, comprising:

(a) heating from about 90% to about 100%, by weight of said composition, of a polyhydroxy fatty acid amide mixture to substantially liquid form; said mixture comprising from about 30% to about 100%, by weight of said mixture, of polyhydroxy fatty acid amide; and (b) mixing until substantially dissolved from about 0.01% to about 10%, by weight of said composition, of a soluble inorganic salt or $C_{1-3}$ carboxylate salt with said heated mixture of step (a); said salt including a metal ion selected from the group consisting of potassium, magnesium, calcium, aluminum, lithium, cesium, strontium, and mixtures thereof;

said composition being pumpable at a temperature between about 70° F. (21.1° C.) and about 120° F. (48.9° C.) and comprising from about 10% to about 60%, by weight, of water.

This invention also encompasses a composition containing polyhydroxy fatty acid amide and certain soluble inorganic salts or salts of $C_{1-3}$ carboxylic acid.

DETAILED DESCRIPTION OF THE INVENTION

This invention provides a process for preparing a polyhydroxy fatty acid amide composition which is pumpable at a temperature between about 70° F. (21.1° C.) and about 120° F. (48.9° C.), preferably between about 75° F. (23.9° C.) and about 110° F. (43.3° C.), most preferably between about 80° F. (26.6° C.) and about 100° F. (37.8° C.). The process comprises:

(a) heating from about 90% to about 100%, by weight of said composition, of polyhydroxy fatty acid amide mixture to substantially liquid form; said mixture comprising from about 30% to about 100%, preferably from about 45% to about 70%, most preferably from about 50% to about 60%, by weight of said mixture, of polyhydroxy fatty acid amide; and (b) mixing until substantially dissolved from about 0.01% to about 10%, preferably from about 0.1% to about 8%, most preferably from about 1% to about 5%, by weight of said composition, of a soluble inorganic salt or $C_{1-3}$ carboxylate salt with the heated mixture of step (a); the salt including a metal ion selected from the group consisting of potassium, magnesium, calcium, aluminum, lithium, cesium, strontium, and mixtures thereof.

Preferably, the composition comprises from about 10% to about 60% by weight of water. In a preferred embodiment, the salt is included as an ingredient in the preparation of polyhydroxy fatty acid amide.

Without meaning to be bound by theory, it is believed that soluble inorganic salts or $C_{1-3}$ carboxylate salts, which do not include sodium or ammonium ions, significantly decrease the melting point of polyhydroxy glucose amide mixtures by reducing hydrogen bonding between the glucose amide and water, thereby allowing easy incorporation into a composition, especially a liquid detergent composition. For example, a preparation of N-methyl glucamide (47.5 wt. %), magnesium chloride (2.5 wt. %) and water (50%) melts at 130° F. (54.4° C.), which is 12° F. (6.7° C.) less than the melting point of N-methyl glucamide. It is also believed that the salt lowers the freezing point, which also makes the polyhydroxy amide easier to handle and formulate.

Polyhydroxy Fatty Acid Amide

The present process is for the preparation of a pumpable polyhydroxy fatty acid amide composition, preferably comprising from about 90% to about 100% (actually 99.09%), by weight of the composition of polyhydroxy fatty acid amide mixture. The polyhydroxy fatty acid amide mixture, which is heated in the first step of the present process, comprises from about 30% to about 100%, preferably from about 45% to about 70%, most preferably from about 50% to about 60%, by weight of the mixture, of one or more polyhydroxy fatty acid amides, most preferably N-methyl glucamide.

The polyhydroxy fatty acid amides herein have the structural formula:

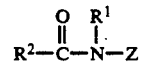

(I)

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight-chain $C_7$–$C_{19}$ alkyl or alkenyl, more preferably straight chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR'(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

The most preferred polyhydroxy fatty acid amide has the general formula

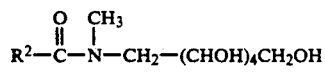

wherein $R^2$ is a straight chain $C_{11}$–$C_{17}$ alkyl or alkenyl group.

Method of Preparing Polyhydroxy Fatty Acid Amide

In general, polyhydroxy fatty acid amides of the present invention can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

In one process for producing N-alkyl or N-hydroxyalkyl, N-deoxyglycityl fatty acid amides wherein the glycityl component is derived from glucose and the N-alkyl or N-hydroxy- alkyl functionality is N-methyl, N-ethyl, N-propyl, N-butyl, N-hydroxyethyl, or N-hydroxypropyl, the product is made by reacting N-alkyl- or N-hydroxyalkyl-glucamine with a fatty ester selected from fatty methyl esters, fatty ethyl esters, and fatty triglycerides in the presence of a catalyst selected from the group consisting of alkali metal alkoxide, trilithium phosphate, trisodium phosphate, tripotassium phosphate, tetrasodium pyrophosphate, pentapotassium tripolyphosphate, lithium hydroxide, sodium hydroxide, potassium hydroxide, calcium hydroxide, lithium carbonate, sodium carbonate, potassium carbonate, disodium tartrate, dipotassium tartrate, sodium potassium tartrate, trisodium citrate, tripotassium citrate, sodium basic silicates, potassium basic silicates, sodium basic aluminosilicates, and potassium basic aluminosilicates, and mixtures thereof. The amount of catalyst is preferably from about 0.5 mole % to about 50 mole %, more preferably from about 2.0 mole % to about 10 mole %, on an N-alkyl or N-hydroxyalkyl-glucamine molar basis. The reaction is preferably carried out at from about 138° C. to about 170° C. for typically from about 20 to about 90 minutes. When triglycerides are utilized in the reaction mixture as the fatty ester source, the reaction is also preferably carried out using from about 1 to about 10 weight % of a phase transfer agent, calculated on a weight percent basis of total reaction mixture, selected from saturated fatty alcohol polyethoxylates, alkylpolyglucosides, linear glucamide surfactant, and mixtures thereof.

Preferably, this process is carried out as follows:

(a) preheating the fatty ester to between about 138° C. and about 170° C.;

(b) adding the N-alkyl or N-hydroxyalkyl glucamine to the heated fatty acid ester and mixing to the extent needed to form a two-phase liquid/liquid mixture;

(c) mixing the catalyst into the reaction mixture; and (d) stirring for the specified reaction time.

Also preferably, from about 2% to about 20% of preformed linear N-alkyl/N-hydroxyalkyl, N-linear glucosyl fatty acid amide product is added to the reaction mixture, by weight of the reactants, as the phase transfer agent if the fatty ester is a triglyceride. This seeds the reaction, thereby increasing the reaction rate.

The polyhydroxy "fatty acid" amide materials used herein also offer the advantages to the detergent formulator that they can be prepared wholly or primarily from natural, renewable, non-petrochemical feedstocks and are degradable.

It should be recognized that along with the polyhydroxy fatty acid amides of Formula (I) above, the processes used to produce them will also typically produce quantities of nonvolatile by-products. The level of these by-products will vary depending upon the particular reactants and process conditions, but are preferably kept to a minimum.

Alternate Method

An alternate method for preparing the polyhydroxy fatty acid amides used herein is as follows. A reaction mixture consisting of 84.87 g. fatty acid methyl ester (source: Procter & Gamble methyl ester CE1270), 75 g. N-methyl-D-glucamine (source: Aldrich Chemical Company M4700-0), 1.04 g. sodium methoxide (source: Aldrich Chemical Company 16,499-2), and 68.51 g. methyl alcohol is used. The reaction vessel comprises a standard reflux set-up fitted with a drying tube, condenser and stir bar. In this procedure, the N-methyl glucamine is combined with methanol with stirring under argon and heating is begun with good mixing (stir bar; reflux). After 15–20 minutes, when the solution has reached the desired temperature, the ester and sodium methoxide catalyst are added. Samples are taken periodically to monitor the course of the reaction, but it is noted that the solution is completely clear by 63.5 minutes. It is judged that the reaction is, in fact, nearly complete at that point. The reaction mixture is maintained at reflux for 4 hours. After removal of the methanol, the recovered crude product weighs 156.16 grams. After vacuum drying and purification, an overall yield of 106.92 grams purified product is recovered. However, percentage yields are not calculated on this basis, inasmuch as regular sampling throughout the course of the reaction makes an overall percentage yield value meaningless. The reaction can be carried out at 80% and 90% reactant concentrations for periods up to 6 hours to yield products with extremely small by-product formation.

The polyhydroxy fatty acid amides derived from coconut alkyl fatty acids (predominantly $C_{12}$–$C_{14}$) are more soluble than their tallow alkyl (predominantly $C_{16}$–$C_{18}$) counterparts. Accordingly, the $C_{12}$–$C_{14}$ materials are somewhat easier to formulate in liquid compositions, and are more soluble in cool-water laundering baths. However, the $C_{16}$–$C_{18}$ materials are also quite useful, especially under circumstances where warm-to-hot wash water is used. Indeed, the $C_{16}$–$C_{18}$ materials may be better detersive surfactants than their $C_{12}$–$C_{14}$ counterparts. Accordingly, the formulator may wish to balance ease-of-manufacture vs. performance when selecting a particular polyhydroxy fatty acid amide for use in a given formulation.

It will also be appreciated that the solubility of the polyhydroxy fatty acid amides can be increased by having points of unsaturation and/or chain branching in the fatty acid moiety. Thus, materials such as the polyhydroxy fatty acid amides derived from oleic acid and iso-stearic acid are more soluble than their n-alkyl counterparts.

Likewise, the solubility of polyhydroxy fatty acid amides prepared from disaccharides, trisaccharides, etc., will ordinarily be greater than the solubility of their monosaccharide-derived counterpart materials. This higher solubility can be of particular assistance when formulating liquid compositions.

The polyhydroxy fatty acid amides can be manufactured not only from the purified sugars, but also from hydrolyzed starches, e.g., corn starch, potato starch, or any other convenient plant-derived starch which contains the mono-, di-, etc. saccharide desired by the formulator. This is of particular importance from the economic standpoint. Thus, "high glucose" corn syrup, "high maltose" corn syrup, etc. can conveniently and economically be used. De-lignified, hydrolyzed cellulose pulp can also provide a raw material source for the polyhydroxy fatty acid amides.

As noted above, polyhydroxy fatty acid amides derived from the higher saccharides, such as maltose, lactose, etc., are more soluble than their glucose counterparts. Moreover, it appears that the more soluble polyhydroxy fatty acid amides can help solubilize their less soluble counterparts, to varying degrees. Accordingly, the formulator may elect to use a raw material comprising a high glucose corn syrup, for example, but to select a syrup which contains a modicum of maltose (e.g., 1% or more). The resulting mixture of polyhydroxy fatty acids will, in general, exhibit more preferred solubility properties over a broader range of temperatures and concentrations than would a "pure" glucose-derived polyhydroxy fatty acid amide. Thus, in addition to any economic advantages for using sugar mixtures rather than pure sugar reactants, the polyhydroxy fatty acid amides prepared from mixed sugars can offer very substantial advantages with respect to performance and/or ease-of-formulation. In some instances, however, some loss of grease removal performance (dishwashing) may be noted at fatty acid maltamide levels above about 25% and some loss in sudsing above about 33% (said percentages being the percentage of maltamide-derived polyhydroxy fatty acid amide vs. glucose-derived polyhydroxy fatty acid amide in the mixture). This can vary somewhat, depending on the chain length of the fatty acid moiety. Typically, then, the formulator electing to use such mixtures may find it advantageous to select polyhydroxy fatty acid amide mixtures which contain ratios of monosaccharides (e.g., glucose) to di- and higher saccharides (e.g., maltose) from about 4:1 to about 99:1.

The manufacture of preferred, uncyclized polyhydroxy fatty acid amides from fatty esters and N-alkyl polyors can be carried out in alcohol solvents at temperatures from about 30° C.–90° C., preferably about 50° C.–80° C. It has now been determined that it may be convenient for the formulator of, for example, liquid detergents to conduct such processes in 1,2-propylene glycol solvent, since the glycol solvent need not be completely removed from the reaction product prior to use in the finished detergent formulation. Likewise, the formulator of, for example, solid, typically granular, detergent compositions may find it convenient to run the process at 30° C.–90° C. in solvents which comprise ethoxylated alcohols, such as the ethoxylated (EO 3-8) $C_{12}$ through $C_{14}$ alcohols, such as those available as NEODOL 23 E06.5 (Shell). When such ethoxylates are used, it is preferred that they not contain substantial amounts of unethoxylated alcohol and, most preferably, not contain substantial amounts of mono-ethoxylated alcohol. ("T" designation.)

Soluble Salts

The salt mixed into the heated polyhydroxy fatty acid amide mixture of the present invention is soluble inorganic salt and/or salt of $C_{1-3}$ carboxylic acid, the salts having certain metal ions (see below). Surprisingly, sodium and/or ammonium salts do not work herein. From about 0.01% to about 10%, preferably from about 0.1% to about 8%, most preferably from about 1% to about 5%, by weight, of these salts can be mixed with the heated liquid polyhydroxy fatty acid amide mixture described above until the salts are substantially dissolved by, for example, stirring or agitation.

The soluble inorganic salts and/or salts Of $C_{1-3}$ carboxylic acid include metal ions which are potassium, magnesium, calcium, aluminum, cesium, strontium or lithium, or mixtures thereof. Preferably the salt is a chloride, sulfate, sulfide, nitrate, formate, acetate and/or propionate. More preferred salts are chloride, sulfate, sulfide or mixtures thereof. Highly preferred salts are magnesium, calcium, aluminum, lithium, or potassium chloride, magnesium sulfate, or mixtures thereof. Most preferred are magnesium chloride and calcium chloride.

Without being bound by theory, it is believed that it is the metal ion which affects the melting point of the polyhydroxy fatty acid rather than, for example, the chloride ion. It is believed that the larger metal ions, such as magnesium, calcium, potassium, cesium, strontium, and aluminum, act as spacers and limit the amount (extent) of hydrogen bonding in the polyhydroxy fatty acid amide. In the case of the metal ion lithium, it is believed that its ability to decrease the melting point is related to its strong affinity for water, thereby creating a bigger hydration radius and thus permitting it to act as a spacer as well. It is believed that this spacing ability of the metal ion allows small amounts of the corresponding soluble salt to be added to the glucose amide in order to decrease the melting point range. Too much salt in the final glucose amide composition is not desirable.

The Process

This invention provides a process for preparing a polyhydroxy fatty acid amide composition which is pumpable between about 70° F. (21.1° C.) and about 120° F. (48.9° C.), preferably between about 75° F. (23.9° C.) and about 110° F. (43.3° C.), most preferably between about 80° F. (26.6° C.) and about 100° F. (37.8° C.). The process comprises heating a polyhydroxy fatty acid amide surfactant mixture comprising from about 30% to about 100%, by weight, of polyhydroxy fatty acid amide surfactant, most preferably $C_{12}$ methyl glucose amide, to a substantially liquid, preferably clear, form. The mixture is preferably heated slowly to just over melting point, for example, between about 143° F. (60° C.) and about 170° F. (76.6° C.) for N-methyl glucosamide, so that the salt can be dissolved in the amide. The amide should be liquid enough for the salt to be readily dissolved in it, but it need not be (and should not be) heated excessively, for example, above about 30° F. (17.8° C.) above the melting point of the amide mixture. A second step, usually taking place in the same vessel, involves mixing from about 0.01% to about 10% of a soluble inorganic salt or $C_{1-3}$ carboxylate salt (which does not include sodium or ammonium ions) together with the heated solution of polyhydroxy fatty acid amide mixture (from step 1). The amount of water present in the process should be from about 10% to about 60%, preferably from about 40% to about 50%. The presence of too much water (greater than about 60%) yields a diluted composition which does not require the addition of salt to maintain a liquid state at lower temperatures. Preferably, the salt is added as an ingredient in the preparation of the polyhydroxy fatty acid amide.

Any polyhydroxy fatty acid amide mixture as described above can be employed herein, preferably a C5-17 alkyl or alkenyl polyhydroxy amide. A particularly preferred process for forming the polyhydroxy fatty acid amide composition is where the polyhydroxy fatty acid amide mixture is formed by reacting an N-alkyl glucamine with a fatty ester in an organic solvent in the presence of a base catalyst and removing said solvent:

(a) preheating the fatty ester and solvent to about 60° C.–70° C.;
(b) adding the N-alkyl glucamine to the heated fatty ester of step (a) and setting the pressure to 100 mm Hg;
(c) heating to 80° C. and removing water and solvent by vacuum;
(d) adding water and warming to from about 40° C. to about 50° C.;
(e) adding base catalyst and reacting without reflux;
(f) agitating and mixing at from about 60° C. to about 70° C.;
(g) adjusting the pH;
(h) adding and mixing from about 0.1% to about 10% of any soluble salt which is not a sodium and/or ammonium salt; and
(i) stirring until the salt is dissolved.

When the salt is a magnesium salt, the pH at step (g) should be adjusted to a pH of from about 7 to about 7.5. Other metal salts can be added in a more alkaline environment (e.g. pH about 7.5 to 9.0). The polyhydroxy fatty acid amide composition herein preferably has a PH between about 7.0 and about 9.0.

An alternative process is as follows.

(a) heating at least about 90%, by weight of the polyhydroxy fatty acid amide composition, of a solid polyhydroxy fatty acid amide mixture consisting of from about 40% to about 95% of polyhydroxy fatty acid amide, to from about 60° C. to about 80° C.;
(b) adding and stirring in from about 0.01% to about 10%, by weight of the polyhydroxy fatty acid composition, of a salt as described above; and
(c) stirring until the salt is dissolved.

The polyhydroxy fatty acid amide composition herein is made pumpable, which means it can easily be transferred from place to place in the plant. It can now be metered more easily and it is more easily combined with other ingredients in a composition, preferably a liquid detergent composition, more preferably a stable light duty liquid comprising from about 0.005% to about 95% by weight of anionic and/or nonionic surfactant, and from about 5% to about 50% by weight of polyhydroxy fatty acid amide composition as described above. Liquid detergent compositions herein preferably have a pH between about 7.0 and about 9.0. The polyhydroxy fatty acid amide composition (i.e. salt already added) remains in a liquid state, usually clear, at temperatures below the normal melting point ranges for polyhydroxy fatty acid amide (e.g. polyhydroxy fatty acid amide compositions can remain in a liquid state for about three weeks at 80° to 100° F., which is 40° to 60° F. below that of a 50% n-cocacyl N-methyl polyhydroxy fatty acid amide mixture). The same amounts and ingredients described above also are preferred in the polyhydroxy fatty acid amide composition. Preferably, the detergent composition comprises from about 5% to about 40%, more preferably from about 5% to about 30%, most preferably from about 8% to about 25%, by weight, of the polyhydroxy fatty acid amide composition described above.

The polyhydroxy fatty acid amide composition can be added to a slurry when, for example, it is to be incorporated into a granular detergent composition. It could alternatively be sprayed on the granules just before or after addition of perfume. It could alternatively be used as a binder for agglomeration of detergent granules.

Other ingredients which could be incorporated into the polyhydroxy fatty acid amide composition before, after, or during the mixing in of the soluble salt are water, methanol, propylene glycol, and monoethanolamine.

The following examples illustrate the processes and compositions of the present invention, but are not necessarily meant to limit or otherwise define the scope of the invention. All parts, percentages and ratios used herein are by weight unless otherwise specified.

EXAMPLE I

Soluble salt is added as the final step in the reaction of N-alkyl glucamine with fatty ester to form polyhydroxy fatty acid amide. The ingredients are set forth in Table 1.

TABLE 1

| Ingredients | % by weight |
|---|---|
| N-methyl glucamine | 25.86 |
| Propylene glycol | 5.00 |
| 95% $C_{12}$ methyl ester | 28.95 |
| 25% sodium methoxide/75% methanol | 2.86 |
| Hydrogen chloride | 0.48 |
| Magnesium chloride hexahydrate | 5.00 |
| Water | Balance |

The addition of magnesium chloride provides a polyhydroxy fatty acid composition which is pumpable at about 30° C. The above is made by combining and heating from 60° to 70° C. the N-methyl glucamine and propylene glycol, and then adding the methanol. The N-methyl glucamine is then added and the pressure set to 100 mmhg. Both water and methanol are removed from the system. The base solution of sodium hydroxide and methanol is added and reacts for two hours. Methanol is removed by vacuum after which water is added and the reaction mix is warmed and agitated followed by neutralization to a pH of 7–7.5. A 50% magnesium chloride hexahydrate solution is added to the reaction mix and is stirred for 10 to 20 minutes.

EXAMPLE II

A solid polyhydroxy fatty acid amide mixture (200 grams) containing about 50.6% polyhydroxy fatty acid amide (90.5% linear $C_{12}$ polyhydroxy fatty acid amide, <0.1% cyclic $C_{12}$ polyhydroxy fatty acid amide, 3.7% methyl esters/soap, 5.5% glucamine and 0.3 ester amides), 44% water, 0.7% methanol and 5% propylene glycol is heated to 170° F. (76.6° C.) until a clear, liquid is obtained. Various amounts of soluble salts as set forth in Table 2 are added and stirred until dissolved using conventional means, preferably mechanical agitation such as a magnetic stirrer or static mixer.

The compositions are put into environments of 80° F. (26.6° C.) or 100° F. (37.8° C.) to see whether the composition remains in a clear, liquid-like state after 3 weeks of storage. Results are shown in Table 2.

TABLE 2

| Ingredient | % by weight | 26.6° C. | 37.8° C. |
|---|---|---|---|
| Magnesium chloride | 4.7% | liquid state | liquid state |
| Magnesium chloride | 2.3% | solid | liquid state |
| Magnesium chloride | 0.5% | solid | solid |
| Magnesium chloride | 0.1%,0.01% | solid | solid |
| Calcium chloride | 3.3% | solid | liquid state |
| Calcium chloride | 2.3%,0.8% | solid | solid |
| Aluminum chloride | 2.8% | liquid state | liquid state |
| Aluminum chloride | 0.6% | solid | liquid state |
| Magnesium acetate | 3.3%,0.7% | solid | solid |
| Lithium chloride | 5.0%,1.0% | solid | solid |
| Potassium chloride | 5.0% | solid | liquid state |
| Potassium chloride | 1.0% | solid | solid |
| Magnesium sulfate | 5.0% | solid | liquid |
| Sodium chloride | 1%,3% 5% | solid | solid |
| Ammonium chloride | 5%,10%,15% | solid | solid |
| Ethanol | 5.0% | solid | solid |
| Ethanol | 10.0% | solid | liquid state |
| Ethanol | 15.0% | liquid state | liquid state |
| $C_{9-11}$ alcohol which has been ethoxylated with 8 moles of ethylene oxide per mole of alcohol | 5%,10%, 15%, 20% | solid | solid |

Compositions containing 3.3% magnesium acetate remain in a liquid state at 100° F. (37.8° C.) for 7 days and compositions containing 5% lithium chloride or 5% magnesium sulfate remain at 100° F. (37.8° C.) in a liquid state for 9 days. Also, compositions containing sodium toluene sulfonate are not in a liquid state at temperatures from 26.6° C. to 38.60° C.

The addition of various salts to a polyhydroxy fatty acid mixture results in a composition which can remain in a liquid state at temperatures significantly below the melting point of the starting mixture. This allows the composition to be pumped without having to use extreme temperatures.

EXAMPLE III

The following light duty liquid compositions of the present invention are prepared by using the glucose amide composition containing magnesium chloride as prepared in Example I. The glucose amide composition can be heated to 100° F. (37.8° C.) and pumped directly with other detergent components as set forth below.

| Component | % by weight A | % by weight B |
|---|---|---|
| Citric acid | 0.05 | |
| Sodium toluene sulfonate | 3.0 | |
| Ethanol | 5.5 | |
| Sodium C12–13 alkyl ethoxy (1.0 ave.) sulfate | 14.5 | 10.0 |
| Sodium C12–13 alkyl ethoxy (3.0 ave.) sulfate | 8.0 | 7.0 |
| Amine oxide | 2.0 | 2.0 |
| C12 alkyl N-methyl glucamide and magnesium chloride | 9.0 | 12.0 |
| Magnesium chloride hexahydrate | 0.9 | 1.84 |
| Hydrogen chloride | 2.0 | |
| Perfume | 0.9 | 0.18 |
| Calcium chloride | | 0.15 |
| Sodium cumene sulfonate | | 4.0 |
| $C_{9-11}$ alcohol-polyethoxylate (9.0) | | 5.0 |

-continued

| Component | % by weight A | B |
|---|---|---|
| Water, trim pH=7.1 at 10% | Balance | |

EXAMPLE IV

The following heavy duty liquid detergent compositions are prepared using the glucamide of Example I. The glucamide composition is heated to 37.8° C. and added as a liquid to the detergent composition.

| Component | % By Weight A | B | C |
|---|---|---|---|
| Fatty acid N-methyl glucamide with magnesium chloride | 7.2 | 8.0 | 8.0 |
| $C_{14-15}$ alkyl polyethoxylate (2.25) sulfuric acid | 10.8 | 12.0 | 12.0 |
| (Alkyl sulfuric acid) | (2.5) | (2.8) | (2.8) |
| $C_{12-13}$ alcohol polyethoxylate (6.5) | 6.5 | 5.0 | 5.0 |
| $C_{12}$ alkyl trimethylammonium chloride | 1.2 | 0.6 | 0.6 |
| $C_{12-14}$ fatty acid | — | — | 2.0 |
| Sodium diethylenetriamine pentaacetate | 0.3 | 0.3 | 0.3 |
| Protease enzyme | As indicated | | |
| Amylase enzyme (325 Am. U/g) | — | — | 0.16 |
| TEPA-$E_{15-18}$* | 1.5 | 2.0 | 2.0 |
| Soil release compound | — | — | 2.5 |
| Monoethanolamine | 2.0 | 2.0 | 1.0 |
| Sodium hydroxide | 1.7 | 4.0 | 2.0 |
| Potassium hydroxide | 4.0 | 1.6 | 5.4 |
| 1,2 Propane diol | 7.25 | 4.0 | 6.5 |
| Ethanol | 7.75 | 8.5 | 7.0 |
| Sodium formate | 1.0 | 1.0 | 1.0 |
| Total calcium ion** (mm/l) | 9.65 | 9.65 | 9.65 |
| Minors and water | Balance to 100 | | |
| Initial pH of 0.2% solution in distilled water at 20° C. | 7.5 | 7.5 | 7.5 |

*Tetraethylene pentamine ethoxylated with 15-18 moles (avg.) of ethylene oxide at each hydrogen site.

**Includes estimated 0.25 millimoles of calcium ion per liter from enzyme slurry and formula water.

EXAMPLE V

A granular laundry detergent composition of the present invention is as follows. The glucamide composition as prepared in Example I may be spray dried, dry mixed or added with other ingredients as a slurry:

| Component | Active Weight % |
|---|---|
| Sodium $C_{14-15}$ alkyl ethoxy (2.5 ave.) sulfate | 12.80 |
| $C_{16-18}$ N-methyl glucamide composition | 12.80 |
| Sodium tripolyphosphate | 2.09 |
| Tetrasodium pyrophosphate | 17.44 |
| Sodium silicate | 7.04 |
| Polyethylene glycol | 0.25 |
| Sodium polyacrylate | 0.88 |
| Sodium perborate monohydrate | 4.32 |
| Sodium carbonate | 20.72 |
| Calcium sulfate dihydrate | 4.80 |
| Others (moisture, brightener, sodium sulfate) | Balance |

EXAMPLE VI

A shampoo composition of the present invention is as follows:

| Component | |
|---|---|
| Ammonium $C_{12-14}$ alkyl sulfate | 2.00 |
| Sodium $C_{12-14}$ alkyl sulfate | 12.00 |
| $C_{12-14}$ N-methyl glucamide composition | 12.00 |
| $C_{12-14}$ alkyl amine oxide | 2.00 |
| $C_{12-14}$ alkyl diethanolamide | 1.00 |
| Calcium chloride dihydrate | 0.74 |
| Magnesium chloride hexahydrate | 2.50 |
| Panthanol* | 0.10 |
| Formaldehyde | 0.20 |
| $C_{12-18}$ hydroxysulfobetaine | 3.00 |
| Others (water, dye, perfume) | Balance |

*2,4-dihydroxy-N-(3-hydroxypropyl)-3,3 dimethylorityramide

What is claimed is:

1. A process for preparing a pumpable polyhydroxy fatty acid amide composition, comprising:

(a) heating to substantially liquid form from about 90% to about 100% by weight of a mixture comprising from about 30% to about 100%, by weight of polyhydroxy fatty acid amide, said mixture being heated to not above 17.8° above its melting point; and (b) mixing until substantially dissolved from about 0.1% to about 10%, by weight of said compositions, of a soluble inorganic salt or $C_{1-3}$ carboxylate salt with said heated mixture of step (a); said salt including a metal ion selected from the group consisting of potassium, magnesium, calcium, aluminum, lithium, cesium, strontium, and mixtures thereof; wherein said composition comprises from about 10% to about 60% by weight of water and said composition is in a liquid state at a melting point below the normal melting point of said polyhydroxy fatty acid amide and is pumpable at a temperature between about 70° F. (21.1° C.) and about 120° F. (48.9° C.).

2. A process according to claim 1 wherein said soluble inorganic salt is selected from the group consisting of chloride, sulfate, sulfide, nitrate, formate, acetate, propionate, and mixtures thereof.

3. A process according to claim 2 wherein said polyhydroxy fatty acid amide is of the formula:

$$R^2-\overset{O}{C}-\overset{R^1}{N}-Z \qquad (I)$$

wherein: $R^1$ is H, $C_1$–$C_4$ hydrocarbyl, 2-hydroxy ethyl, 2-hydroxy propyl, or a mixture thereof; and $R^2$ is a $C_5$–$C_{31}$ hydrocarbyl; and Z is a polyhydroxyhydrocarbyl having a linear hydrocarbyl chain with at least 3 hydroxyls directly connected to the chain, or an alkoxylated derivative.

4. A process according to claim 3 wherein said soluble inorganic salt is selected from the group consisting of chloride, sulfate, sulfide, nitrate, and mixtures thereof.

5. A process according to claim 4 wherein said soluble inorganic salt or $C_{1-3}$ carboxylate salt is from about 0.1% to about 8% by weight of said composition.

6. A process according to claim 5 wherein said soluble inorganic salt is magnesium chloride or calcium chloride.

7. A process according to claim 5 wherein said soluble inorganic salt is mixed in by agitation and stirring.

8. A process according to claim 6 wherein said polyhydroxy fatty acid amide is formed prior to step (a) by reacting an N-alkyl glucamine with a fatty ester in an organic hydroxy solvent in the presence of a base catalyst and removing said solvent.

9. A process according to claim 8 wherein said polyhydroxy fatty acid amide composition has a pH between about 7.0 and about 9.0.

10. A process according to claim 9 wherein said N-alkyl glucamine is N-methyl glucamine.

11. A process according to claim 10 wherein said composition is pumpable at a temperature between about 80° F. (26.6° C.) and about 100° F. (37.80° C.).

* * * * *